United States Patent [19]

Braunschweiler

[11] 4,212,699

[45] Jul. 15, 1980

[54] APPARATUS FOR ASSEMBLING PLANAR WORK PIECES

[75] Inventor: Hans-Georg Braunschweiler, Riniken, Switzerland

[73] Assignee: Georg Fischer Brugg - Oehler AG, Switzerland

[21] Appl. No.: 934,583

[22] Filed: Aug. 17, 1978

[30] Foreign Application Priority Data

Sep. 12, 1977 [CH] Switzerland ..... 11544/77

[51] Int. Cl.[2] ..... B27D 3/00; B30B 15/30; B30B 15/34

[52] U.S. Cl. ..... 156/558; 100/93 P; 100/215; 100/226; 144/281 R; 144/281 C; 156/539; 156/559; 156/583.1

[58] Field of Search ..... 156/512, 558, 559, 499, 156/539, 583.1; 144/281 R, 281 C, 314 A; 100/93 P, 196, 207, 226, 215

[56] References Cited

U.S. PATENT DOCUMENTS

| | | | |
|---|---|---|---|
| 2,526,342 | 10/1950 | Frisch | 144/281 C |
| 3,000,410 | 9/1961 | Rothrock | 156/559 |
| 3,068,512 | 12/1962 | Van Houten | 100/93 P |
| 3,444,029 | 5/1969 | Renaud et al. | 156/304 |
| 3,752,060 | 8/1973 | Hubert et al. | 100/196 X |
| 3,919,039 | 11/1975 | Rohner | 100/226 X |

*Primary Examiner*—Michael G. Wityshyn
*Attorney, Agent, or Firm*—Roylance, Abrams, Berdo & Farley

[57] ABSTRACT

A machine for edge-to-edge joining of planar sheets or strips of material into a board or ribbon of material includes an upper fixed press platen, a lower vertically movable platen, a plurality of rails between the two platens for curing glue used in the joining process, and a delivery table which is movable to and from a position between the platens. The delivery table is provided with grooves holding spacer members to maintain the strips in evenly spaced relationship. Glue is applied to the strips and they are placed on the table, and the table is then moved between the platens. The rails press the strips upwardly against the upper platen, and the lower platen is then moved upwardly to compress the strips, and is shiftable longitudinally to move them into abutting relationship. The initial spacing and subsequent abutment during the assembling and pressing prevent overlapping of the pieces during the joining process.

7 Claims, 11 Drawing Figures

APPARATUS FOR ASSEMBLING PLANAR WORK PIECES

This invention relates to an apparatus for assembling and gluing together substantially planar work pieces made of wood, particularly wood veneer, to form boards thereof.

BACKGROUND OF THE INVENTION

Assembling machines for joining pieces of veneer are known, one example of such a machine being found in Swiss Pat. No. 425,182. In that patent, pieces of veneer are fed into a machine, the pieces extending transversly to the direction of transportation. The pieces are assembled and glued together in the machine one after the other into a continuous ribbon of veneer. With such machines, it is not possible to produce plywood boards which are visibly assembled prior to gluing together. In other words, it is not possible to observe the pieces of veneer as they are initially placed into the relationship which they will occupy in the final product, and it is therefore not possible to form a board or ribbon of material which has a surface corresponding to a desired decoration.

A manually operated arrangement is shown in German Pat. No. 948,916, wherein it is possible to observe the pieces of material as they are placed into position for a subsequent gluing together, but the manual operation disclosed therein is not suitable or profitable for an industrial manufacturing process.

In U.S. Pat. No. 2,526,342, there is shown an apparatus by which wooden strips or boards can be visually assembled into a desired relationship and assembled mechanically by pressing together the lateral edges which have been previously wetted with glue to form boards. With this arrangement, however, it is not possible to assemble thin work pieces or pieces or veneer into boards by gluing them under pressure. In that patent, the sides of the wooden strips which are to glued together must be disposed longitudinally with respect to the direction of passage and it is therefore not possible to also and simultaneously put several boards together into an elongated ribbon of material.

BRIEF DESCRIPTION OF THE INVENTION

Accordingly, it is an object of the present invention to provide an arrangement of apparatus by which thin planar work pieces such as, for example, veneers, can be visually assembled into a desired pattern and can then be glued together mechanically and simultaneously into a board or ribbon of material.

Briefly described, the invention includes an apparatus for the assembly and adhering together of a plurality of substantially planar sheets of material, such as wood veneer, to form a unitary board therewith, comprising an upper fixed press platen, a lower press platen, said lower platen being vertically movable toward and away from the upper platen and being shiftable in a direction substantially parallel with the upper platen, a delivery table for receiving planar sheets of material with adhesive applied thereto, the table being movable to a position below the upper platen and fixation means for promoting curing of the adhesive between said upper and lower platens, the fixation means being vertically movable toward and away from the upper platen.

In order that the manner in which the foregoing and other objects are attained in accordance with the invention can be understood in detail, particularly advantageous embodiments thereof will be described with reference to the accompanying drawings, which form a part of this specification, and wherein.

Figure 1:
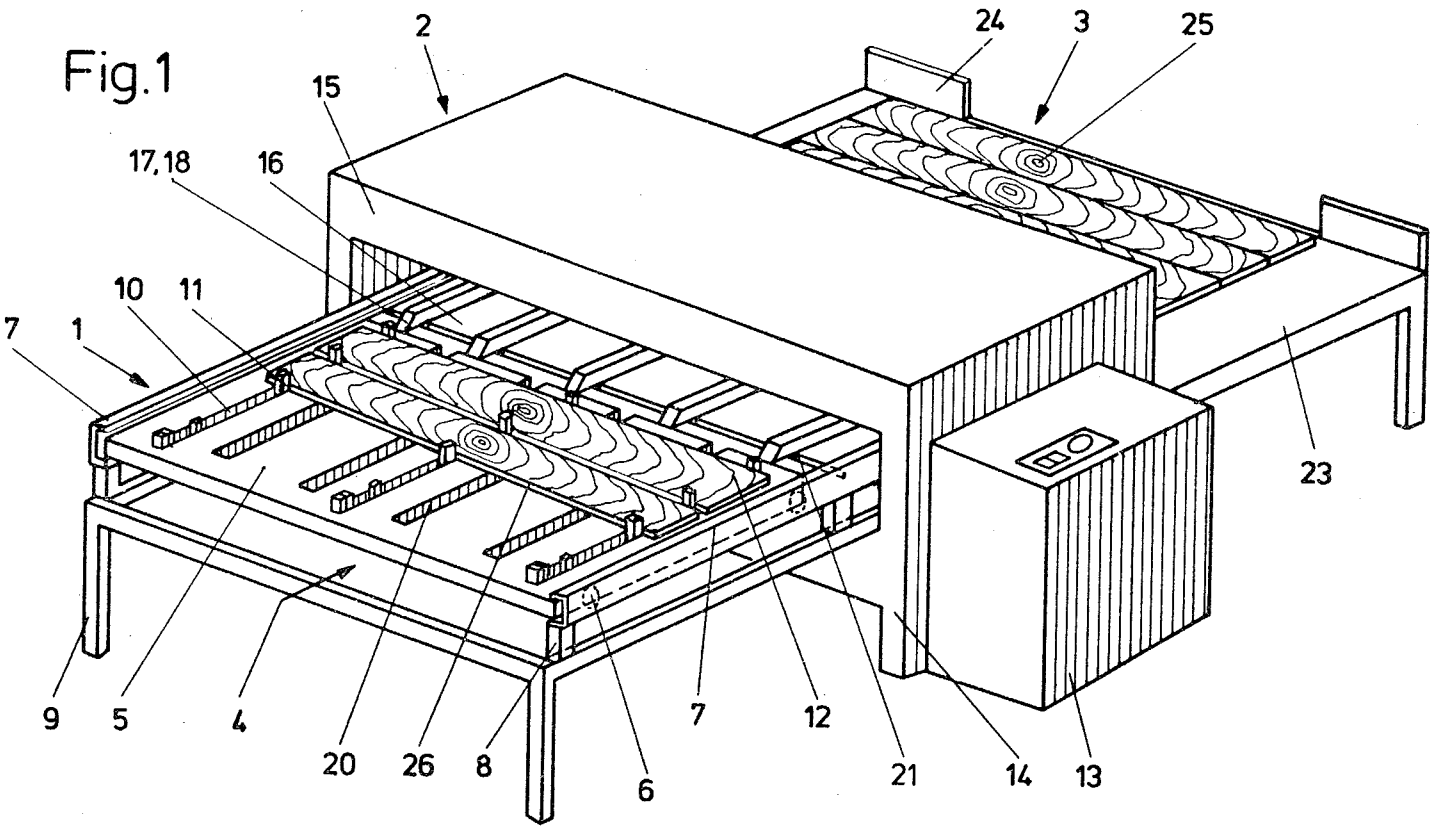
FIG. 1 is a simplified perspective view of an apparatus in accordance with the invention.

As seen in FIG. 1, the apparatus includes a feed arrangement indicated generally at 1, a press arrangement indicated generally at 2, a stacking arrangement indicated generally at 3, and a control apparatus 13. The feed arrangement 1 includes a delivery table 5 which is longitudinally movable in the direction of arrow 4, table 5 being guided by rollers 6 which ride in side channels or rails 7. The rails 7, which are on opposite sides of the table, are shaped as inwardly facing U-shaped members and are attached by means of supports 8 to a frame 9. Frame 9 is fixedly attached to pressing apparatus 2.

The rails 7 extend into and substantially through the pressing arrangement 2 so that the delivery table 5 is longitudinally movable from the position illustrated in FIG. 1 into the pressing arrangement. This movement is accomplished as a result of a conventional drive which can be, for example, an hydraulic or pneumatic thrust piston drive, as schematically indicated at 30 (FIG. 2) an electromechanical spindle drive, or any other convenient drive means.

In the embodiment shown, the delivery table 5 is provided with means defining longitudinal grooves 10 which extend parallel to the direction of movement 4 of the table 5. A plurality of individually and independently movable spacer members 11 are disposed in each of the grooves 10. The spacers 11 can be individually shifted by hand or can be moved by means of a piece of veneer 12, or other work piece, which is to be put on the table in such a way that, in each groove 10, a spacer 11 is arranged to lie between that piece of veneer and the next. Thus, the various pieces of veneer which are placed on the table are separated uniformly by at least two spacer members, resulting in a uniform spacing being established between the applied pieces of veneer 12. As will be apparent from FIGS. 8 and 9, the longitudinal grooves 10 are constructed as inverted T-grooves. In the embodiment shown, there are three longitudinal grooves 10 in the table, at least two such grooves being required for reliable functioning. It will be observed that the grooves terminate inwardly of the ends of table 5, the ends of the grooves thereby constituting a limit at the ends for the shiftable spacers 11 and, thus, also a stop for the first piece of veneer placed on the table (see also FIG. 2).

Figure 2:
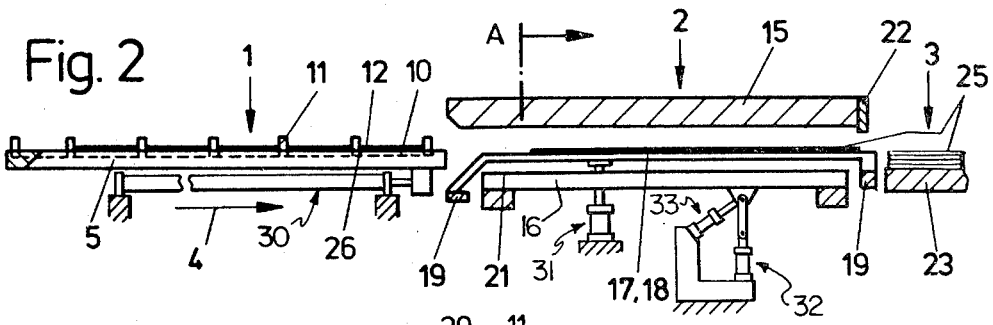
FIG. 2 is a simplified and schematic longitudinal section through the apparatus of FIG. 1, shown in a first operating position.
Figure 7:
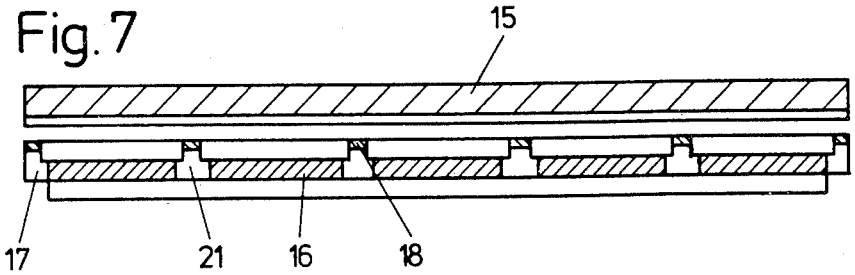
FIGS. 7–11 are transverse sectional views along line AA of FIGS. 2–6, respectively.

The press apparatus 2 comprises a frame 14, an upper fixed press platen 15 having a downwardly facing working surface, a lower movable press platen 16 having an upwardly facing working surface, and a fixing means 17 disposed therebetween. The fixing arrangement is vertically movable, i.e., liftable and lowerable, by means such as hydraulic or pneumatic cylinders schematically indicated at 31 (FIG. 2), the fixing means including a plurality of heatable rails 18 which extend in parallel relationship with each other and also in parallel to the direction of movement 4. At opposite ends the rails are interconnected with each other by cross-strips 19, as shown in FIGS. 2 and 7. The rails 18 can be heated by means of a resistance heating system or a liquid heating system. In order for the delivery table 5 to be insertable between two press platens 15 and 16 and for the fixing means 17 to be liftable against the upper press platen 16, the delivery table 5 is provided with a plurality of recesses 20 disposed in the vicinity of rails 18, the width of each of the recesses being greater than the width of rails 18 to provide clearance.

The lower press platen 16 may be pressed by means of any pressing drive arrangement such as a piston arrangement schematically shown at 32 (FIG. 2) against the upper press platen 15 and is also arranged to be shiftable by a shifting arrangement 33, in the direction of movement of arrow 4 in a direction substantially parallel to the upper press platen 15 so that the return shifting into the starting position may take place during or after the lowering process.

The pressing arrangement as well as the shifting arrangement can consist of, for example, pneumatically or hydraulically driven cylinder and piston assemblies. The lower press platen 16 is likewise equipped with recesses 21 extending in the direction of movement 4 so that, when they are lifted against the upper press platen 15, the rails 18 of the fixing means 17 can lie in the recesses 21.

A stop strip 22 is attached to the upper press platen 15 at its output end so that the first piece of veneer 12 placed on the table and inserted into the press apparatus can abut against the stop strip during the joining and pressing process. This is best seen in FIGS. 2–6.

The stacking arrangement 3 comprises a stacking table 23 provided with stops 24 and serves for the depositing of the assembled and glued-together plywood boards 25. A transfer arrangement can also be included in the stacking arrangement 3 so that individual or several stacked plywood boards 25 can be conveyed to a transporting and packaging apparatus.

The manner in which the above-described apparatus operates will be apparent from FIGS. 2–11 and is hereinafter described.

Individual pieces of veneer, or other material to be joined, are placed on the delivery table 5 by hand, the longitudinal sides 26 being previously provided with a coating of glue, the pieces being arranged to lie transversely with respect to the direction of movement 4. It will be observed that the pieces of veneer, as seen in FIG. 1, can be selected in correspondence with a desired decorative arrangement and can be assembled substantially as they will appear in the completed board. Between the individual pieces of veneer 12 the spacers 11, guided in longitudinal grooves 10 are pushed longitudinally along the grooves so that there is always a uniform gap between adjacent ones of the veneer pieces. The primary purpose of the spacing is to guarantee that during the assembly and motion of the pieces and during the fixation step the pieces of veneer cannot be pressed against each other in such a way that one piece tends to ride up over an adjacent piece, the pieces being prevented from abutting directly against each other until the appropriate time in the process when pressure is applied by the upper and lower platen members.

Figure 3:
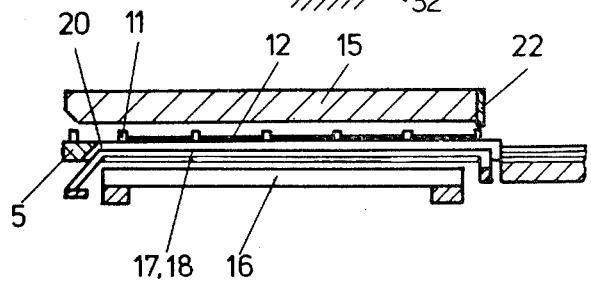
FIG. 3 is a sectional view similar to FIG. 2 and in a second operating position.
Figure 4:
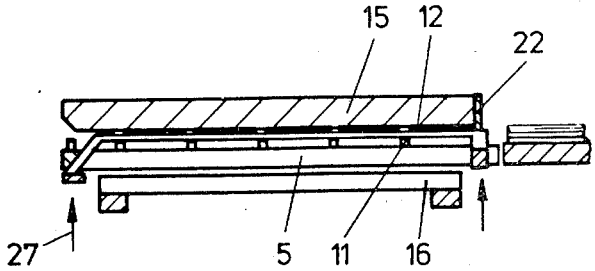
FIG. 4 is a view similar to FIGS. 2 and 3 and showing a third operating position of the apparatus.
Figure 5:
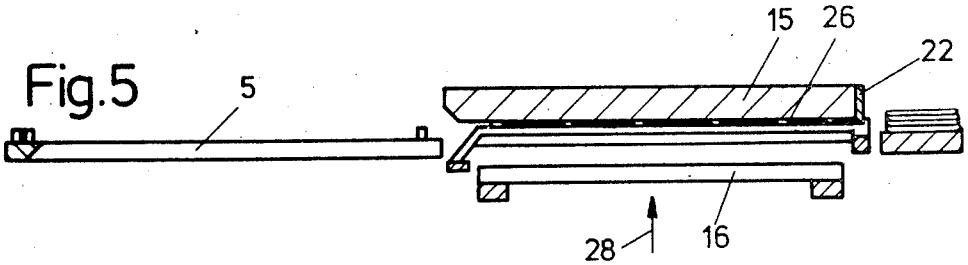
FIG. 5 is a view similar to FIGS. 2–4 showing a fourth operating position.
Figure 6:
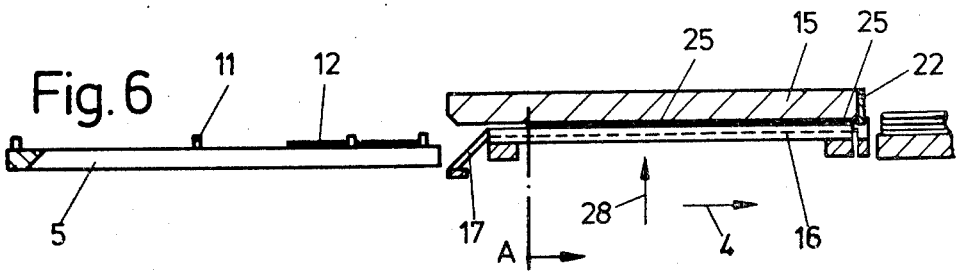
FIG. 6 is a view similar to FIGS. 2–5 showing a fifth operating position of the apparatus.
Figure 8:
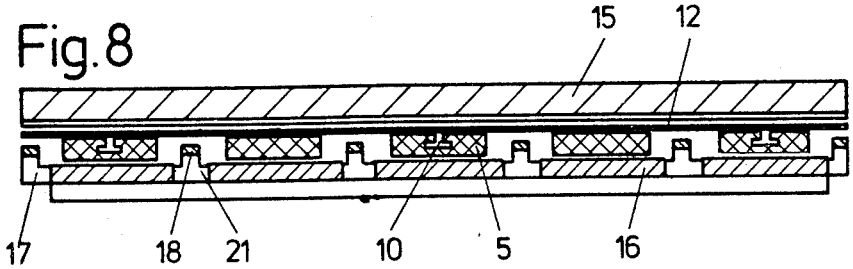
Figure 9:
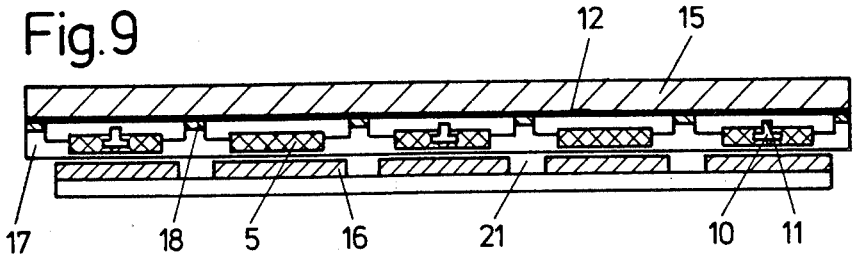
Figure 10:
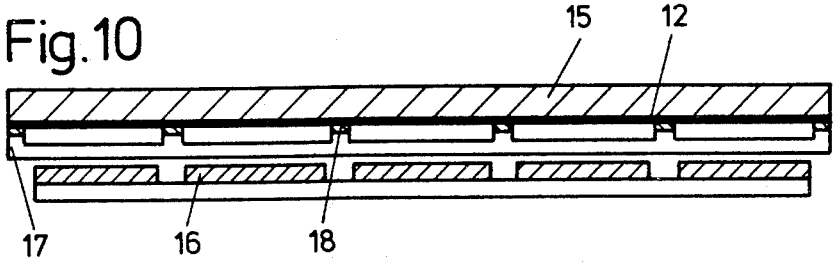
Figure 11:
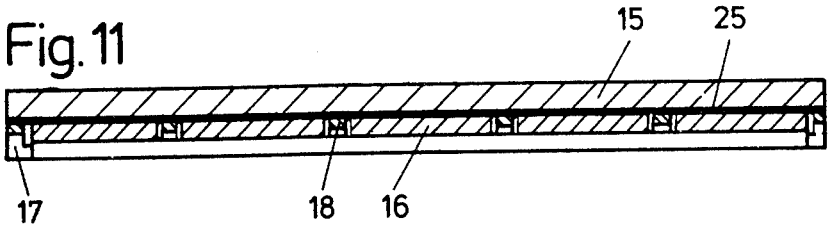

As soon as the pieces of veneer 12 required for a plywood board 25 have been placed on the delivery table 5, the table is shifted automatically into the pressing apparatus 2 by triggering a starting signal and it will be observed at this stage that the fixation means 17 and the lower press platen 16 are in their lower positions as shown in FIGS. 3 and 8. If a previously assembled plywood board 25 still exists in the pressing apparatus, the completed board is pushed by the delivery table 5 onto the stacking table 23 when the table with the newly placed strips is inserted into the pressing apparatus. As soon as the delivery table 5 reaches its terminal position, as illustrated in FIG. 3, the fixation means 17 is lifted automatically as shown by arrows 27 (FIG. 4) so that the rails 18 located in the recesses 20 of the delivery table 5 lift the individual pieces of veneer 12 and press them against the lower working surface of the fixed upper press platen 15 (see FIGS. 4 and 9). The first placed piece of veneer lies, at that stage, a short distance short of the stop strip 22 attached to the upper platen 15 while the remaining pieces lie firmly, uniformly spaced from one another, against the working surface of upper platen 15. The delivery table 5 is then returned to its starting position (see FIG. 5) whereupon the lower press platen 16 is pressed vertically upwardly by means of a pressure drive arrangement in the direction of arrow 28 against the pieces of veneer 12, being pressed against the upper press platen 15. During this step the rails 18 lie in the recesses 21 provided in platen 16. While the pressure is applied, the lower press platen 16 is then moved in the direction of arrow 4 which causes the individual pieces of veneer to be shifted in the direction of arrow 4 in such a way that the first one is pressed firmly against stop strip 22 and subsequent ones are firmly pressed against each other so that all of the adjacent edges of the various pieces are brought into firm abutting relationship. It will be observed that the coefficients of friction of the components must be selected such that the coefficient of friction between the working surface of upper platen 15 and of the fixation means 17 are to be lower than the coefficient of friction between the veneer pieces and lower platen 16 so that the shifting of the lower platen guarantees driving of the pieces of veneer into the above-described abutting relationship.

Pressure in the direction of arrows 4 and 28 is then maintained until a firm glued connection of the assembled pieces of veneer is established. During this time, the delivery table 5 is supplied with new pieces of veneer 12 for the production of the next plywood board 25. After the adhesive has been cured or dried, depending upon the nature of the adhesive used, the lower press platen is returned downwardly to its starting position and fixation means 17 is also lowered, the finished plywood board lying on the fixation means (see FIGS. 2 and 7), and a new operating cycle can be commenced with the insertion of the delivery table into the press apparatus 2 and simultaneous ejection of the finished plywood board 25 onto the stacking table 23. The entire sequence can readily be made automatic by incorporating suitable switches and control elements in the control arrangement 13.

As a result of the fact that the veneer pieces are adhered together in directions transverse to the direction of motion, it is also possible to assemble the finished plywood board directly into a ribbon by pressing the first of the newly inserted veneers against the last of the veneer pieces assembled into a board immediately before, instead of using the stop strip 22. For this purpose, stacking table 23 can be replaced by an apparatus to hold the previously completed board in the position of stop strip 22.

The arrangement according to the invention will guarantee a faultless, simultaneous assembly and gluing together of several pieces, particularly thin planar pieces such as veneers, into a board so that the individual pieces of veneer are first arranged visually to correspond to a desired decor. Since this apparatus permits the production of boards as well as ribbons, the machine is universally usable for both small scale operations and mass production.

While certain advantageous embodiments have been chosen to illustrate the invention it will be understood by those skilled in the art that various changes and modifications can be made therein without departing from the scope of the invention as defined in the appended claims.

What is claimed is:

1. An apparatus for the assembly and adhering together of a plurality of substantially planar sheets of material, such as wood veneer, to form a unitary board therewith comprising:

an upper fixed press platen;

a lower press platen, said lower platen being vertically movable toward and away from said upper platen and shiftable in a direction substantially parallel with said upper platen;

a delivery table for receiving planar sheets of material with adhesive applied thereto, said table being movable to a position below said upper platen; and fixation means for promoting curing of the adhesive between said upper and lower platens, said fixation means being vertically movable toward and away from said upper platen, wherein said lower platen is shiftable in the direction of movement of said table, and wherein the coefficient of friction of the upwardly facing surface of said lower platen is significantly greater than the working surfaces of said upper platen and said fixation means so that shiftable movement of said lower platen when in contact with the planar sheets brings the adjacent planar sheets into an abutting relationship.

2. An apparatus according to claim 1 wherein said fixation means includes a plurality of rails extending in the direction of movement of said table, and at least one cross strip interconnecting said rails at at least one end thereof.

3. An apparatus according to claim 2 wherein said fixation means includes means for heating said rails.

4. An apparatus according to claim 2 wherein each of said delivery table and said lower platen includes means defining recesses for receiving said rails.

5. An apparatus according to claim 1 wherein said delivery table includes at least two longitudinal grooves extending parallel to its direction of movement, and a plurality of independently movable spacer means disposed in said groove for separating said planar sheets.

6. An apparatus according to claim 1 wherein said upper platen has an input end and an output end, and includes a stop strip protruding downwardly therefrom across said output end.

7. An apparatus for the assembly and adhering together of a plurality of substantially planar sheets of material, such as wood veneer, to form a unitary board therewith comprising:

an upper fixed press platen;

a lower press platen, said lower platen being vertically movable toward and away from said upper platen and shiftable in a direction substantially parallel with said upper platen;

a delivery table for receiving planar sheets of material with adhesive applied thereto, said table being movable to a position below said upper platen; and fixation means for promoting curing of the adhesive between said upper and lower platens, said fixation means being vertically movable toward and away from said upper platen, said delivery table including at least two longitudinal grooves extending parallel to its direction of movement, and a plurality of independently movable spacer means disposed in said grooves for separating said planar sheets.

* * * * *